US012262743B2

(12) United States Patent
Van Lancker et al.

(10) Patent No.: US 12,262,743 B2
(45) Date of Patent: Apr. 1, 2025

(54) AEROSOL GENERATING DEVICE WITH MODULAR COMPONENTS

(71) Applicant: PHILIP MORRIS PRODUCTS S.A., Neuchâtel (CH)

(72) Inventors: Pieter Van Lancker, Gijzenzele (BE); Valerio Oliana, Pully (CH); Virginie Garcia, Lausanne (CH)

(73) Assignee: Philip Morris Products S.A., Neuchâtel (CH)

( * ) Notice: Subject to any disclaimer, the term of this patent is extended or adjusted under 35 U.S.C. 154(b) by 65 days.

(21) Appl. No.: 17/769,470

(22) PCT Filed: Oct. 14, 2020

(86) PCT No.: PCT/IB2020/059656

§ 371 (c)(1),
(2) Date: Apr. 15, 2022

(87) PCT Pub. No.: WO2021/074820

PCT Pub. Date: Apr. 22, 2021

(65) Prior Publication Data

US 2023/0413900 A1 Dec. 28, 2023

(30) Foreign Application Priority Data

Oct. 16, 2019 (EP) ..... 19203687

(51) Int. Cl.

| | |
|---|---|
| ***A24F 40/40*** | (2020.01) |
| ***A24F 40/65*** | (2020.01) |
| ***A24F 40/95*** | (2020.01) |

(52) U.S. Cl.
CPC ..... *A24F 40/40* (2020.01); *A24F 40/65* (2020.01); *A24F 40/95* (2020.01)

(58) Field of Classification Search
CPC ..... A24F 40/40; A24F 40/65; A24F 40/95; A24F 40/00; A24F 15/01; A24F 15/12; A24F 40/46; A24F 40/50; A24F 40/51; A24F 40/60; A24F 47/00; A24D 1/20
See application file for complete search history.

(56) References Cited

U.S. PATENT DOCUMENTS

| | | | |
|---|---|---|---|
| 7,079,028 | B2 | 7/2006 | Herrmann et al. |
| 8,483,758 | B2 | 7/2013 | Huang |
| 8,891,800 | B1 | 11/2014 | Shaffer |

(Continued)

FOREIGN PATENT DOCUMENTS

| | | |
|---|---|---|
| KR | 20110006894 | 7/2011 |
| WO | 20160023809 | 2/2016 |

OTHER PUBLICATIONS

European Search Report for EP 19203687.9 issued by the European Patent Office, May 6, 2020; 6 pgs.

(Continued)

*Primary Examiner* — Truc T Nguyen
(74) *Attorney, Agent, or Firm* — Mueting Raasch Group

(57) ABSTRACT

An aerosol generating system includes an aerosol generating device (100), a first module (201), and a second module (202). The aerosol generating device comprises a housing (110). The first module is operably couplable to the housing of the aerosol generating device. The second module is operably couplable to the first module or to the housing of the aerosol generating device.

13 Claims, 9 Drawing Sheets

(56) References Cited

U.S. PATENT DOCUMENTS

| | | | | |
|---|---|---|---|---|
| 9,118,750 | B2 | 8/2015 | Vossoughi et al. | |
| 9,584,639 | B2 | 2/2017 | Slaby et al. | |
| 11,083,220 | B2 | 8/2021 | Reevell | |
| 2016/0286015 | A1 | 9/2016 | Kim | |
| 2017/0208700 | A1 | 7/2017 | Elmieh | |
| 2017/0333651 | A1 | 11/2017 | Qiu | |
| 2017/0334605 | A1* | 11/2017 | Murphy | F01N 13/1805 |
| 2018/0338531 | A1 | 11/2018 | Reevell | |
| 2019/0173509 | A1 | 6/2019 | Martin et al. | |
| 2019/0174827 | A1* | 6/2019 | Fernando | H01R 4/48 |
| 2020/0077706 | A1* | 3/2020 | Wilson | A61M 15/009 |
| 2020/0154773 | A1* | 5/2020 | Lim | A24F 40/53 |

OTHER PUBLICATIONS

International Search Report and Written Opinion for PCT/IB2020/059656 issued by the European Patent Office, Feb. 5, 2021; 16 pgs.
International Preliminary Report on Patentability for PCT/IB2020/059656, issued by the European Patent Office, Mar. 9, 2022; 10 pgs.

* cited by examiner

AEROSOL GENERATING DEVICE WITH MODULAR COMPONENTS

This application is the § 371 U.S. National Stage of International Application No. PCT/IB2020/059656, filed 14 Oct. 2020, which claims the benefit of European Application No. 19203687.9, filed 16 Oct. 2019, the disclosures of which are incorporated herein by reference.

This disclosure relates to aerosol generating articles and systems and, more particularly, to systems that include an aerosol generating device and associated modules.

Aerosol generating devices deliver aerosol from aerosol forming substrates to a user for inhalation. Many aerosol generating devices include electronic components to provide a primary function of generating an aerosol from the substrate or to provide secondary functionality such as wireless communication, displays or LED's used to provide information to a user, audible feedback, location tracking, and the like.

Once an aerosol generating device is produced, it may be difficult or impossible to alter one or more of the secondary functionalities of the device. However, different users may desire different secondary functionalities. Accordingly, manufacturers include many secondary features in an aerosol generating device to appeal to a wide audience of consumers. However, inclusion of many secondary functionalities may increase to the cost to produce the aerosol generating device and may increase the complexity of the aerosol generating device.

The aerosol generating systems described herein include a base aerosol generating device with limited secondary functionality and modules that may be added by a user. The modules provide secondary functionality and thus allow a user to select appropriate secondary functionality by selecting which modules to add. The modules may be swapped so that the user may alter secondary functionality as needed or desired.

The aerosol generating systems described herein may include an aerosol generating device, a first module, and a second module. The aerosol generating device comprises a housing. The first module is operably couplable to the housing of the aerosol generating device. The second module is operably couplable to the first module or to the housing of the aerosol generating device.

The first module and second module may be separately coupled to the housing of the device.

The second module may couple to the first module. When the first module is connected to the aerosol generating device, coupling of the second module to the first module may cause electronics of the second module to electrically connect with electronics of the aerosol generating device. For example, the first module may comprise a first electrical interconnect that electrically contacts an electrical interconnect of the housing of the aerosol generating device and may comprise a second electrical interconnect that electrically contacts an electrical interconnect of the second module. The first and second electrical interconnects of the first module are electrically coupled. The first module may be passive.

The system may further comprise one or more additional modules. Each additional module may operably couple to one or more of another additional module, the first module, the second module, and the housing of the aerosol generating article. Preferably, each additional module is operably couplable to each additional module, the first module, the second module, and the housing of the aerosol generating article.

The aerosol generating systems described herein may provide one or more advantages over previously available aerosol generating devices and systems. For example, the aerosol generating systems described herein allow a manufacturer to produce a simple, low cost base aerosol generating unit with limited secondary functionalities. The aerosol generating systems described herein allow a user to select desired functionalities via modules that are operably couplable to the base device. The aerosol generating systems described herein allow a user to alter the secondary functionalities from time to time, as desired. The aerosol generating systems described herein provide for some degree of future proofing, as new modules employing new technologies may be manufactured as new technologies become available.

These and other advantages will be apparent to those of skill in the art upon reading the present disclosure and accompanying figures.

The aerosol generating system may include any suitable aerosol generating device. Examples of suitable aerosol generating devices include devices that heat an aerosol forming substrate to volatilize one or more constituents of the substrate to form an aerosol, devices that do not heat the substrate but rather use air flow to entrain particles in the air flow to form an aerosol, and devices that use a chemical reaction to cause formation of volatile compounds to form an aerosol. Aerosol generating devices that heat an aerosol forming substrate may sufficiently heat the substrate to volatilize one or more constituents of the substrate but do not burn the substrate.

Aerosol generating devices may be configured to receive a consumable comprising an aerosol forming substrate, such as a nicotine-containing aerosol forming substrate. The substrate may be in any suitable form. The substrate may comprise tobacco. The substrate may include a liquid composition comprising nicotine. The substrate may comprise a dry powder containing nicotine, such as a nicotine salt.

The aerosol generating devices may be e-cigarettes or other vaping-type devices that use a consumable comprising an e-liquid. The aerosol generating devices may be devices configured to receive a consumable comprising a rod of aerosol forming substrate such as tobacco and to heat the substrate to volatilize one or more constituents of the substrate without burning the substrate. The aerosol generating device may comprise an inhaler device configured to entrain in the air flow particles released from a consumable comprising a dry powder, such as a dry powder comprising nicotine.

The term "aerosol" is used herein to refer to a suspension of fine solid particles or liquid droplets in a gas, such as air, which may contain volatile flavor compounds.

The aerosol generating devices comprise a housing and may include one or more electronic components. The one or more electronic components may be disposed interior to the housing. The one or more electronic components may allow for the device to serve the primary function of generating an aerosol from the aerosol forming substrate and may provide for some secondary functionality.

Components needed to provide the primary function of generating an aerosol from the aerosol forming substrate may vary depending on the aerosol generating device and the aerosol forming substrate employed with the device. The aerosol generating device may include a power source, such as a battery, a controller operably coupled to the power source, a user interface such as a button switch operably coupled to the controller, and an aerosol generating element operably coupled to the controller. If the aerosol generating device generates an aerosol from the aerosol forming substrate by mechanically vibrating the substrate, the aerosol generating element may comprise a vibrating element. The vibrating element may generate vibration by any suitable mechanism, such as by ultrasonic vibrating or surface acoustic wave (SAW) aerosol generation. To facilitate ultrasonic vibrating, the device or the component of the consumable may be provided with a piezoelectric transducer. To facilitate SAW aerosol generation, the device or the component of the consumable may be provided with a piezoelectric a SAW chip including a piezoelectric substrate and one or more interdigital transducers (I DTs). If the aerosol generating device generates an aerosol from the aerosol forming substrate by heating the substrate, the aerosol generating element may comprise a heating element. The heating element may generate heat by any suitable mechanism, such as by resistive heating or induction. To facilitate inductive heating, the device or the component of the consumable comprising the aerosol forming substrate may be provided with a susceptor. Any suitable susceptor material may be used. One example of a suitable susceptor material is aluminium. The device may comprise suitable coils to inductively heat the susceptor. In addition or alternatively, the heating element may comprise a resistive wire, a resistive mesh, or other resistive element that may heat when an electric current is applied to the resistive element.

The controller may be configured to control the temperature at which, or to which, the aerosol forming substrate is heated. For example, the controller may be configured to monitor the electrical resistance of the heating element and to control the supply of power to the heating element depending on the electrical resistance of the heating element. In this manner, the controller may regulate the temperature of the resistive element. The controller may be configured to control the power applied to the coils to control the temperature of a susceptor. In addition or alternatively, a susceptor having a maximum inductive heating temperature in a desired range may be employed.

The aerosol generating device may comprise a temperature sensor, such as a thermocouple. The temperature sensor may be operably coupled to the controller to control or adjust the amount of aerosol. The temperature sensor may be operably coupled to the controller to control the temperature of the heating element if the device generates aerosol from an aerosol forming substrate by heating the substrate. The temperature sensor may be positioned at any suitable location. For example, the temperature sensor may be configured to insert into the consumable comprising the aerosol forming substrate to monitor the temperature of the aerosol forming substrate being heated or vibrated. In addition or alternatively, the temperature sensor may be in contact with the heating element. In addition or alternatively, the temperature sensor may be positioned to detect temperature at an aerosol outlet of the device or a portion thereof. The sensor may transmit signals regarding the sensed temperature to the controller. The controller may adjust heating of the heating element in response to the signal to achieve a suitable temperature at the sensor.

In some instances, where primary functionality of the device does not require a controller or a power supply, such as when the device does not require heat or vibration to generate an aerosol (e.g., an inhaler for inhaling a dry powder containing nicotine or a nicotine salt), the aerosol generating device may still comprise a power supply and a controller for providing power and some functionality to the modules that may be operably coupled to the aerosol generating device.

The aerosol generating device may be configured to provide one or more secondary functionalities that are not associated with the primary function of generating aerosol from the aerosol forming substrate. For example, the device may comprise a battery level indicator to provide the user with feedback. The indicator may be operably coupled with the controller, which may be operably coupled to the battery.

Many or most of the secondary functionalities may be carried out by one or more modules employed with the aerosol generating device. The functionalities may be altered by the user by changing the module or modules employed.

Preferably, the aerosol generating device is configured for use with at least two modules. The two modules or more may be used simultaneously or may be used separately. Each of the two or more modules may be operably coupled to the aerosol generating device directly or indirectly through another module coupled to the aerosol generating device.

The modules may be connected to the aerosol generating device inside of the housing of the aerosol generating device or they may attach to the outside of the housing of the aerosol generating device. Preferably, the modules attach to the outside of the housing of the aerosol generating device.

The modules may be connected to the housing of the aerosol generating unit at any suitable location. For example, the modules may be connected to a side, the front, the back, the bottom or the top, or all around the housing of the aerosol generating device.

Each of the modules may be connected to another module or the housing of the aerosol generating device. The modules are preferably physically securable to the housing of the aerosol generating device or to another module. Preferably, the physical connection is reversible.

Any suitable connection between a module and the housing of the aerosol generating device or another module may be used. For example, the connection may comprise one or more of a mechanical connection, or a magnetic connection, such as a connection employing a permanent magnet or an electromagnet. Examples of mechanical connections that may be employed include slide connectors, snap connectors, or the like. Additional examples of connection mechanisms that may be employed include peelable adhesive, adhesive tape, an elastic band, electrostatic energy, suction tape, hook and loop connectors, and the like. However, more stable mechanical connectors or magnetic connectors are preferred.

Each module may comprise two or more connectors, such that the module may be connected to the housing of the aerosol generating device and another module or may be connected to two other modules at the same time. Preferably, each of the modules employs the same connection mechanisms.

The modules may be of uniform size and shape or may be of different size and shape. The modules may provide one or more secondary functionalities that may or may not be related to the primary function of the aerosol generating device.

The modules may be active or passive. For purposes of this disclosure, "active" modules are modules that include electronic components to provide at least one primary function of the module, and "passive modules" are modules that do not require electronic components to carry out a primary function of the module.

Examples of components that a passive module may include are one or more of: a container for spent consumables such as heat sticks; an analog watch; a charging cable, such as a cable with USB connectors; a cash money container; a payment card container; a business card retainer; a bottle opener; a key container; one or more functions form a swiss army knife; a pen or pencil; an earbud holder; a keychain ring; and a general container.

Examples of components that an active module may include are one or more of: a secondary battery; wireless communication components; wireless charger components, which may be one-way or two-way; long range wireless charging components, such as radio frequency (RF) based charging components, ultrasound-based charging components, light-based charging components; solar powered charger component; a lighter, such as a plasma lighter or a resistive lighter, for conventional cigarettes; additional security elements such as an electronic key, a code lock, and the like; an AC charger with pins for a wall outlet; a second heating engine with different geometry as primary heating engine; a charging case for wireless ear pods; a fan; a display; a speaker; a flashlight such a light emitting diode; a wireless remote; a pico projector; a camera; a haptic feedback module; a sensor pack including one or more of a barometer, a thermometer, a microphone, a light intensity sensory, a gyroscope, an aerosol sensor such as a particulate sensor, a wind sensor, a color sensor, a liquid sensor, a humidity sensor, an activity sensor, a biometric sensor, a pressure sensor, an air flow sensor, and a chemical sensor; a near field communication (NFC) reader, a processor and memory; an electrical switch such as button switch; a universal serial bus (USB) hub; and a global positioning system (GPS).

The active modules may comprise an electrical interconnect for electrically coupling with another module or the aerosol generating device. The electrical interconnect may contact a corresponding interconnect of the other module or the aerosol generating device when the module is attached to the other module or the housing of the aerosol generating device. The passive modules may comprise electrical interconnects to provide pass-through electrical connection between active modules operably connected to the passive module when the passive module is physically between the active modules or to an active module and the aerosol generating device when the passive module is physically between the active module and the aerosol generating device. The electrical interconnects may comprise a physical connector with one or more contact points. For example, the electrical interconnects may comprise a proprietary connector, an existing connector such as a type of USB connector or a lightning connector, or any other suitable connector.

The electrical interconnects may transfer power, data, or power and data. The power, data, or power and data flow may be one-way (e.g., from the aerosol generating device to the module or from the module to the aerosol generating device) or two-way.

In addition or alternatively, the data interface, power interface, or data interface and power interface may be provided by a wireless connection. Wireless transfer may require suitable components in both the module and the aerosol generating device. For example, the active modules may comprise components that allow for wireless data transfer, wireless power transfer, or wireless data and power transfer between another active module, the aerosol generating device, or both the other active module and the aerosol generating device. The aerosol generating article, the active modules, or both the aerosol generating article and the active module may be configured to wirelessly transfer data with a secondary device, such as a smartphone, a wearable device, a computer, a server, and the like. Any suitable wireless connection may be employed. Examples of suitable wireless connection include one or more of RF-based wireless connection; light-based connection, sound-based connection, and magnetic induction-based connection. Examples of suitable RF-based connection include NFC; Bluetooth; Bluetooth Low-energy; Wireless USB; Wi-Fi; White-Fi; Wi-Fi HalLow; Wi-FAR; wireless regional area network (WRAN); wireless local area network (WLAN); low power wireless area network (LPWAN) such as Sigfox, LoRa, INGenu, Waviot, NB-Iot, LTE-M, Telensa, CYANconnode, Weightless, and the like; phone data connection such as general packet radio service (GPRS), long term evolution (LTE), third generation LTE (3G), fourth generation LTE 4G, fifth generation LTE 5G, and the like; zigbee; z-wave; RuBee; TransferJet; and the like. Examples of light-based connection include infrared, Li-Fi, optical such a camera and QRcode or barcode; and the like. An example of sound-based connection is sonic communication. An example of magnetic induction-based connection is near-field magnetic induction (NFMI) communication.

Electrical components of active modules may be powered by a power supply of the aerosol generating device.

Preferably, the modules are hot swappable.

Preferably, no user input is need to setup the modules. The modules may be plug-and-play modules.

In some embodiments, one or more module may be applied to the aerosol generating device by the manufacturer. The manufacturer may produce a number of modules having various secondary functionalities, the user may place a custom order, and the manufacturer may produce and ship a made-to-order device to the customer.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

A "controller" as used herein may comprise one or more processors, such as microprocessors. The one one or more processors may operate with associated data storage, or memory, for access to processing programs or routines and one or more types of data that may be employed to carry out the illustrative methods described herein. For example, processing programs or routines stored in data storage may include programs or routines for performing statistics, matrix mathematics, compression algorithms (e.g., data compression algorithms), standardization algorithms, comparison algorithms, or any other processing used to implement the one or more illustrative methods and processes described herein. Further, for example, processing programs or routines stored in data storage may include processes and functions to wirelessly transfer data between the aerosol generating device or intermediary device and the vending apparatus.

The controller may implement one or more computer programs executed on one or more programmable processors that include processing capabilities (e.g., microcontrollers, programmable logic devices, etc.), data storage (e.g., volatile or non-volatile memory and/or storage elements), input devices, and output devices. Program code or logic described herein may be applied to input data to perform functionality described herein and generate desired output information. The output information may be applied as input to one or more other devices or processes as described herein or as would be applied in a known fashion.

The computer programs used to implement the processes described herein may be provided using any programmable language, e.g., a high-level procedural or object orientated programming language that is suitable for communicating with a computer system. Any such program products may, for example, be stored on any suitable device, e.g., a storage media, readable by a general or special purpose program, controller apparatus for configuring and operating the computer when the suitable device is read for performing the procedures described herein. In other words, the controller may implement a non-transitory computer readable storage medium, configured with a computer program, where the storage medium causes the computer to operate in a specific and predefined manner to perform functions described herein.

The exact configuration of the controller is not limiting and essentially any device or devices capable of providing suitable computing capabilities and control capabilities to implement the illustrative methods described herein may be used. In view of the above, it will be readily apparent that the functionality as described herein may be implemented in any manner as would be known to one skilled in the art. As such, the computer language, the controller, or any other software/hardware which is to be used to implement the processes described herein shall not be limiting on the scope of the systems, processes or programs (e.g., the functionality provided by such processes or programs) described herein. The methods and processes described in this disclosure, including those attributed to the systems, or various constituent components, may be implemented, at least in part, in hardware, software, firmware, or any combination thereof. For example, various aspects of the techniques may be implemented within one or more processors, including one or more microprocessors, DSPs (Digital Signal Processers), ASICs (Application-Specific Integrated Circuits), FPGAs (Field Programmable Gate Arrays), CPLDs (Complex Programmable Logic Devices, microcontrollers, or any other equivalent integrated or discrete logic circuitry, as well as any combinations of such components. When implemented in software, the functionality ascribed to the systems, devices, and methods described in this disclosure may be embodied as instructions on a computer-readable medium such as RAM (random access memory), ROM (read-only memory), NVRAM (Non-Volatile Random-Access Memory), (electrically erasable programmable read-only memory) EEPROM, flash memory, magnetic data storage media, optical data storage media, or the like. The instructions may be executed by one or more processors to support one or more aspects of the functionality described in this disclosure.

Reference will now be made to the drawings, which depict one or more aspects described in this disclosure. However, it will be understood that other aspects not depicted in the drawing fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components.

Figure 1A:
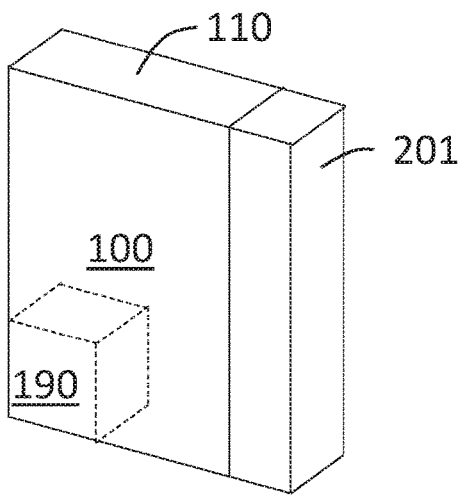
FIGS. 1A-1D are schematic perspective views of an aerosol generating device and two modules illustrating some possible connection schemes between the modules and the aerosol generating device.

The schematic drawings are not necessarily to scale and are presented for purposes of illustration and not limitation.

Referring now to FIGS. 1A-1D, a system comprising an aerosol generating device 100, a first module 201, and a second module 202 is shown. The aerosol generating device 100 comprises a power supply 190 and may contain a controller operably coupled to the power supply 190. The aerosol generating device 100 comprises one or more connectors (not shown) for operably coupling modules 201, 202 to the housing 110 of the aerosol generating device 110. When connected to the housing 110 of the aerosol generating device 110, the modules 201, 202, or components thereof, are electrically coupled with the power supply 190, controller, or power supply 190 and controller of the aerosol generating device 100.

In FIG. 1A, the aerosol generating device 100 is operably coupled to the first module 201. The first module 201 comprises one or more connectors (not shown), at least one of which, provides for operably connection to a connector (not shown) of the aerosol generating device 100.

Figure 1B:
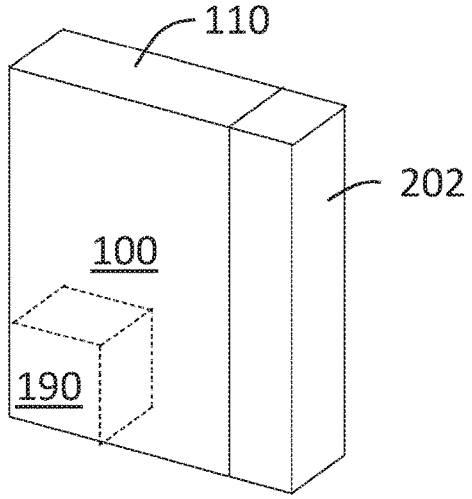
Figure 1C:
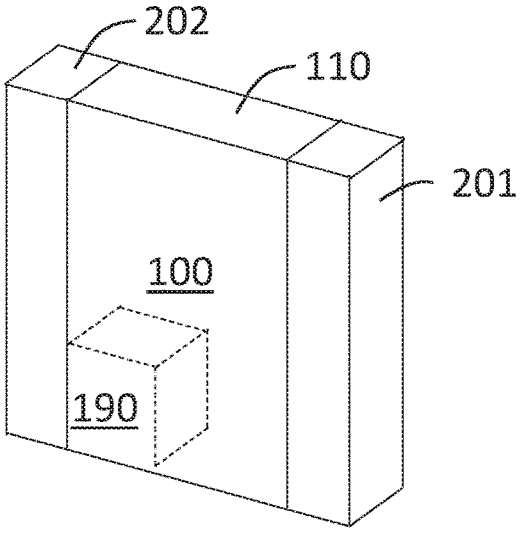

In FIG. 1B, the aerosol generating device 100 is operably coupled to the second module 202. The second module 202 comprises one or more connectors (not shown), at least one of which, provides for operably connection to a connector (not shown) of the aerosol generating device 100.

As shown in FIGS. 1A and 1B, the modules 201, 202 may be swapped and separately couplable to the aerosol generating device 100.

Figure 1D:
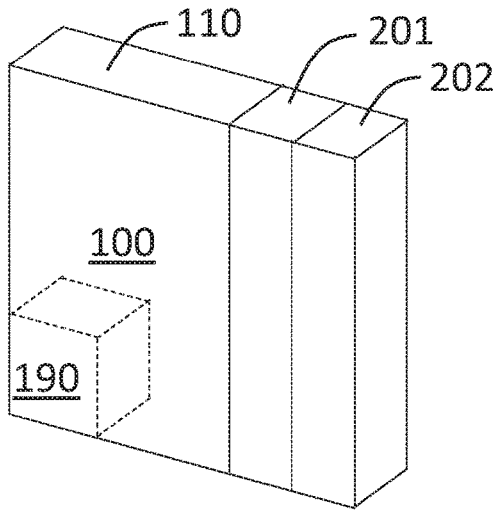

In FIGS. 10 and 1D, both the first module 201 and the second module 202 are simultaneously operably coupled to the aerosol generating device 100. Each of the first module 201 and the second module 202 are electrically coupled with the power supply 190, controller, or power supply 190 and controller of the aerosol generating device 100. In FIG. 10, the first module 210 and second module 202 are connected to opposing sides of the aerosol generating device 100. Accordingly, the aerosol generating device 100 comprises a first connector (not shown) for connecting the first module 201 and a second connector (not shown) for connecting second module 202.

In FIG. 1D, the first module 201 is connected to the housing 110 of the aerosol generating device 100, and the second module 202 is connected to the first module 201. The second module 202 is electrically coupled with the power supply 190, controller, or power supply 190 and controller of the aerosol generating device 100 via the first module 201. The first module 201 contains electrical interconnects (not shown) for electrically coupling to the power supply 190, controller, or power supply 190 and controller of the aerosol generating device 100 and to the second module 201. The first module 201 may be a passive module, and the electrical interconnects (not shown) may be pass-through interconnects. Accordingly, an intervening passive module 201 will not prevent, but rather will facilitate, electrical connection between an active module 202 and the power supply 190, controller, or power supply 190 and controller of the aerosol generating device 100.

In this manner, a user may indiscriminately swap or add active and passive modules to the system without fear that a module may not properly function unless connected in a particular sequence.

Figure 2A:
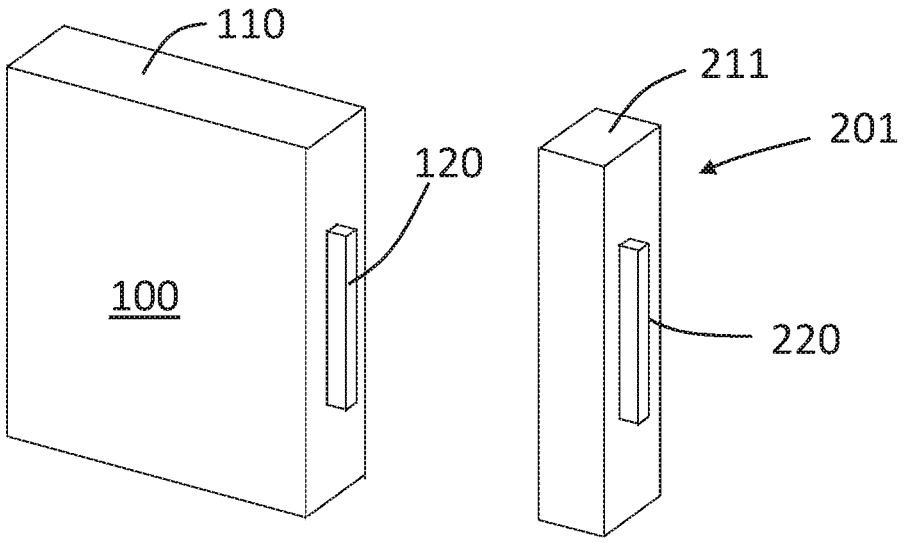
FIG. 2A is a schematic perspective view of an aerosol generating device and a module that may be connected to the aerosol generating device.
Figure 2B:
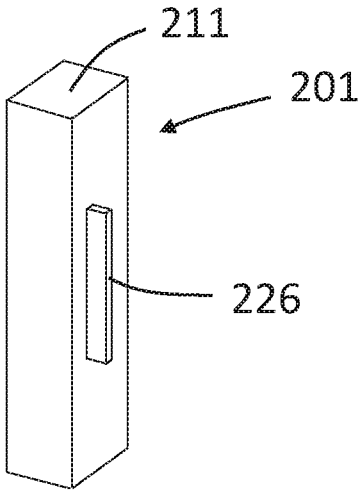
FIG. 2B is a schematic perspective view of the module shown in FIG. 2A showing an opposing side of the module relative to FIG. 2A.
Figure 3A:
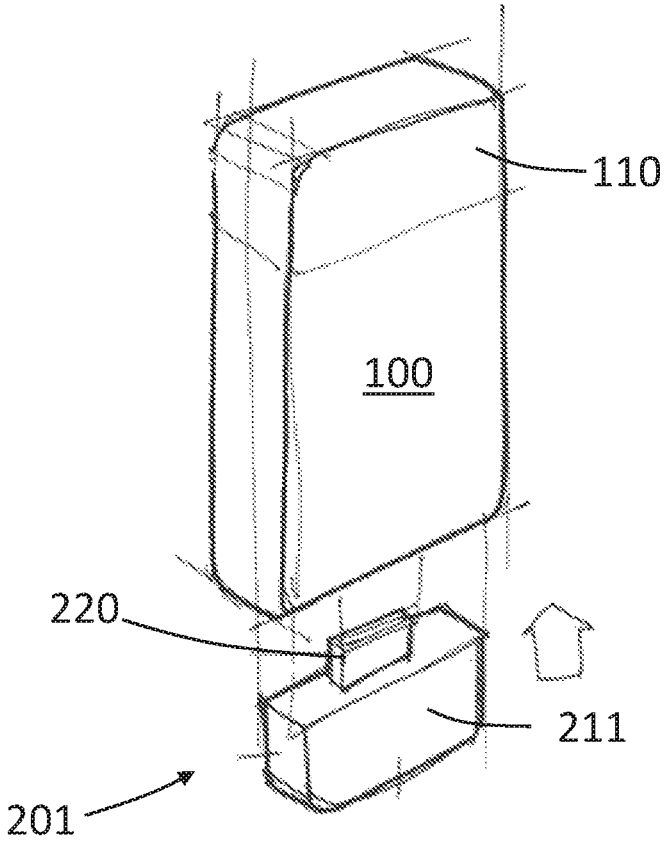
FIG. 3A is a schematic perspective view of an aerosol generating device and a module that may be connected to the aerosol generating device.
Figure 3B:
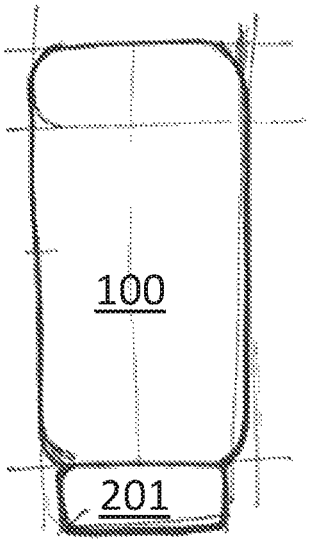
FIG. 3B is a schematic side plan view of the aerosol generating device and the module shown in FIG. 3A, showing the device and module connected.

Referring now to FIGS. 2A and 2B, a system including an aerosol generating device 100 and a module 201 is shown. The device 100 and module 201 may be as described above regarding FIGS. 1A-1D. FIGS. 2A and 2B show some additional detail regarding connection mechanisms that may be employed to operably couple the aerosol generating device 100 to the module 201. The aerosol generating device 100 includes a connector 120 accessible from the exterior of the housing 110 of the device 100. The connector 120 includes an electrical interconnect. For example, the connector 120 may comprise a USB connector. The connector 120 may comprise a female USB connector. The module 201 includes a connector 220 accessible from the exterior of the housing 211 of the module 201. The connector 220 includes an electrical interconnect. For example, the connector 220 may comprise a USB connector. The connector 220 may comprise a female USB connector, which may receive a male USB connector of another module (not shown) to allow connection of additional modules (for example, as shown in FIG. 1D).

In FIG. 2B, the opposite side of the module 201 from the side comprising the first connector 220 is shown. As shown in FIG. 2B, the module 201 comprises a second connector 226 configured to connect with connector 120 of the aerosol generating device 100. The connector 226 may be a male USB connector. The first 220 and second 226 connectors of the module 201 are electrically coupled so that coupling of an additional module (not show) to connector 220 will result in electrical coupling of the additional module with the aerosol generating device 100.

FIGS. 3-9 illustrate various embodiments of modules 201 and aerosol generating devices 100 and associated connections. In FIGS. 3A and 3B, module 201 is a wireless charging module to allow wireless charging of a power supply of the aerosol generating device 100. Module 201 includes a USB connector 220 extending exterior to the housing 211 of the module 201. The device 100 includes a corresponding connector (not shown) which is accessible from the exterior of the housing 110 of the device and may be recessed within the housing 110.

Figure 4A:
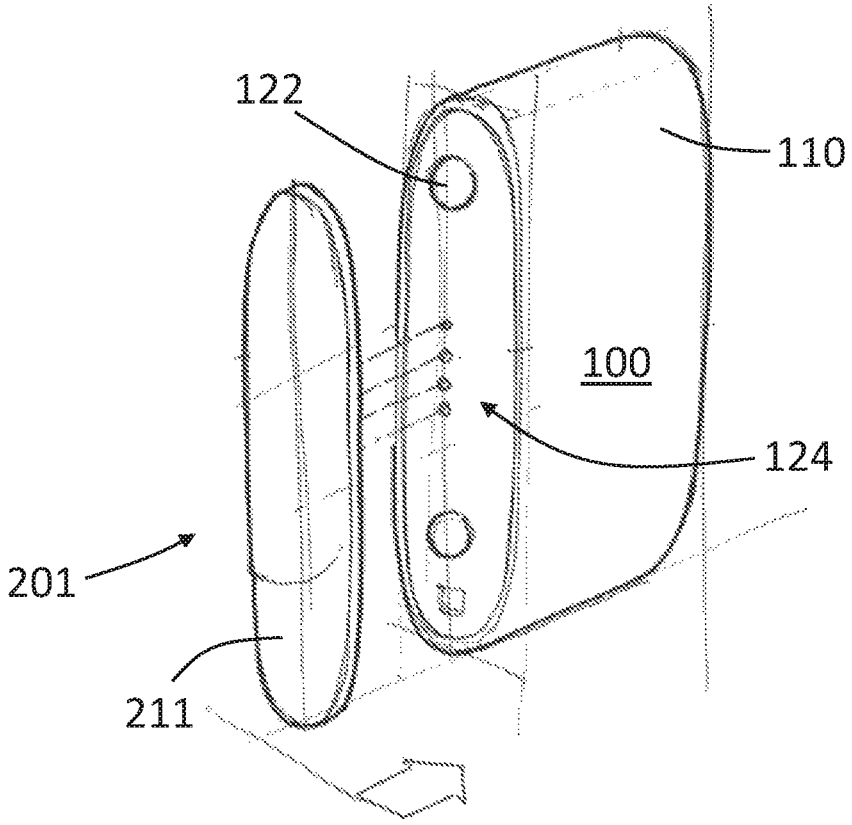
FIG. 4A is a schematic perspective view of an aerosol generating device and a module that may be connected to the aerosol generating device.
Figure 4B:
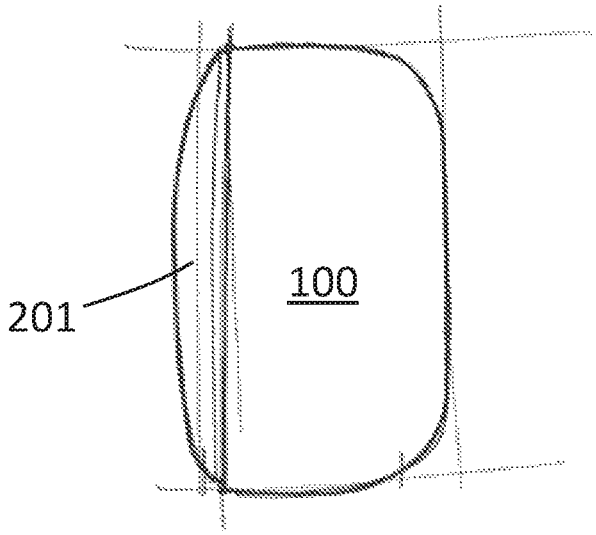
FIG. 4B is a schematic side plan view of the aerosol generating device and the module shown in FIG. 4A, showing the device and module connected.

FIGS. 4A and 4B illustrate a device 100 having separate mechanical connectors 122 and electrical connector 124. The electrical connector 124 comprises a pin type connector configured to receive pins (not shown) extending from the housing 211 of the module 201. The mechanical connector 122 includes a snap type connector accessible from the exterior of the housing 110 of the device 100 and recessed in the housing 110. The mechanical connector 124 is configured to receive a corresponding connector (not shown) extending from the housing 211 of the module 201.

Figure 5A:
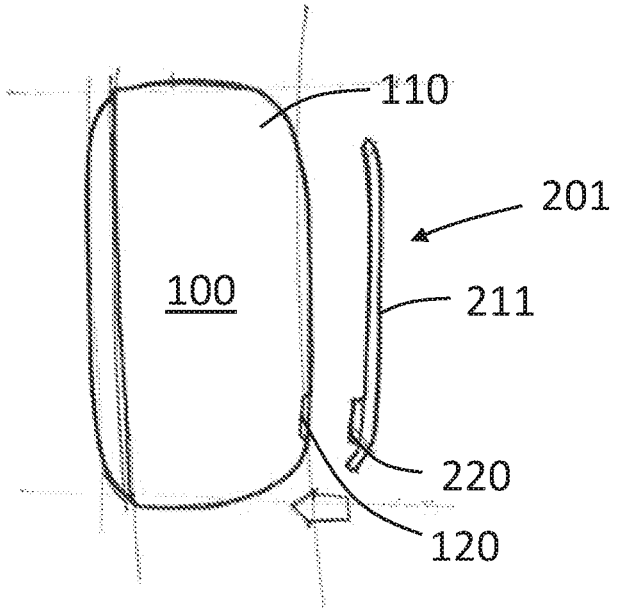
FIG. 5A is a schematic side plan view of an aerosol generating device and a module that may be connected to the aerosol generating device.
Figure 5B:
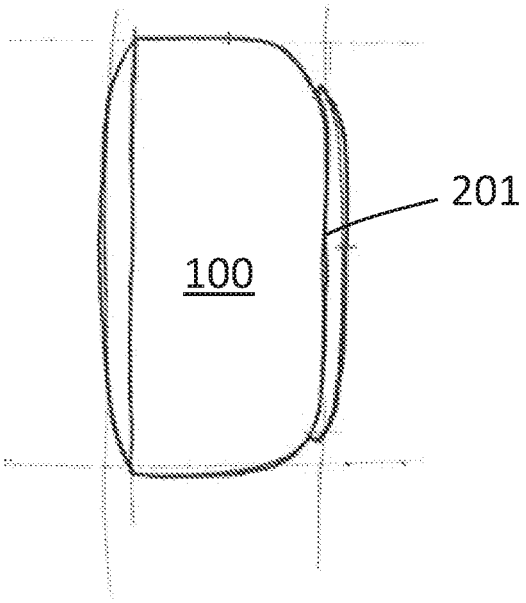
FIG. 5B is a schematic side plan view of the aerosol generating device and the module shown in FIG. 5A, showing the device and module connected.
Figure 5C:
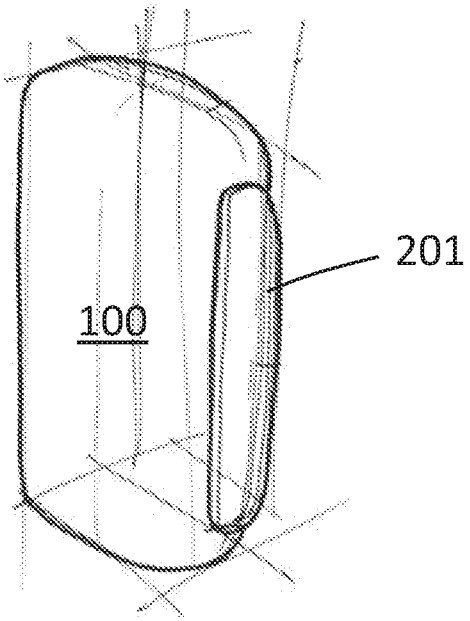
FIG. 5C is a schematic perspective view of the aerosol generating device and the module shown in FIG. 5A, showing the device and module connected.

FIGS. 5A-5C show an aerosol generating device 100 and a module 201 operably coupleable to the device 100. The module 201 includes a USB type connector 220 extending from the housing 211 of the module, and the device 100 includes a corresponding USB type connector 120 recessed in, but accessible external to, the housing 110 of the device 100.

Figure 6A:
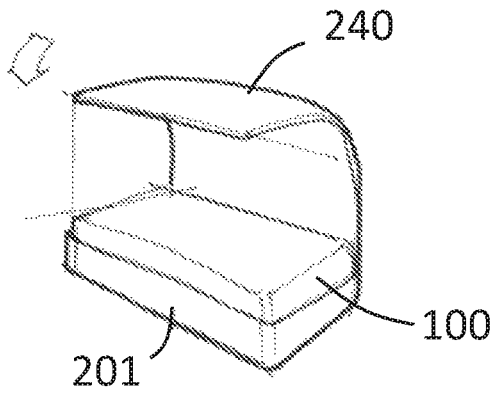
FIG. 6A is a schematic perspective view of an aerosol generating device and a module that may be connected to the aerosol generating device.
Figure 6B:
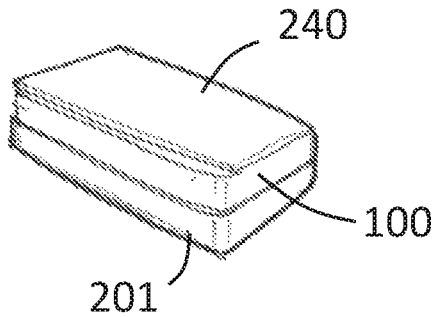
FIG. 6B is a schematic perspective view of the aerosol generating device and the module shown in FIG. 6A, showing the device and module connected.
Figure 6C:
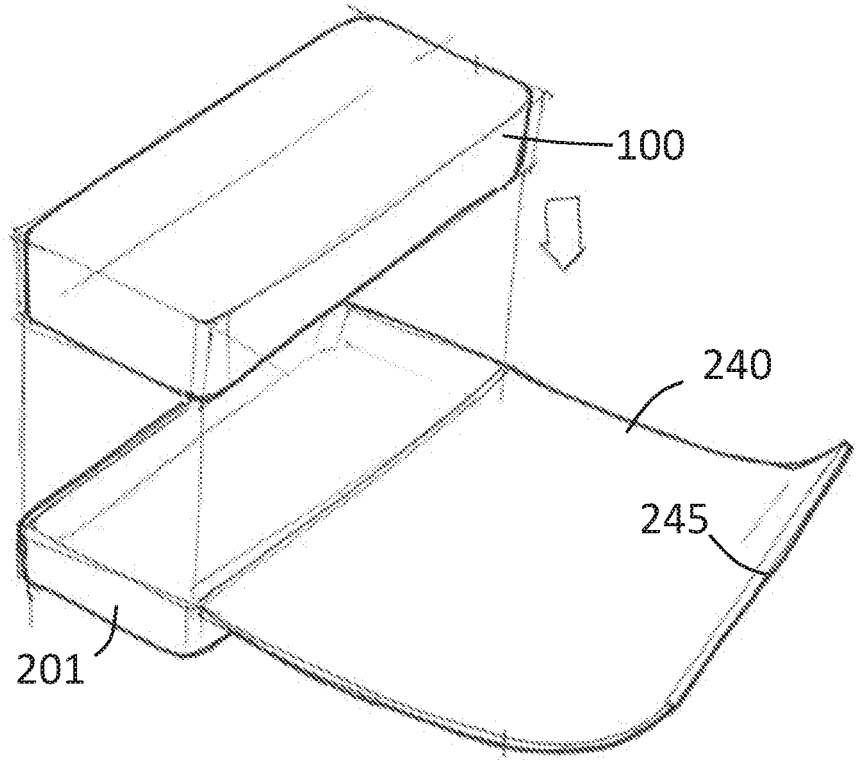
FIG. 6C is a schematic perspective view of the aerosol generating device and the module shown in FIG. 6A.

FIGS. 6A-6C show an aerosol generating device 100, a wrap connector 245, and a module 201 operably coupleable to the device 100 via the wrap connector 245. The wrap connector 245 may form a part of the module 201 as shown, may form a part of the device 100 (not shown), or may be separate from, but coupleable to, the module 201 and the device 100 (not shown). The device 100 and module 201 may be appropriately positioned relative to one another and the wrap connector 245 may be wrapped about one or both of the device 100 and module 201 to retain the device 100 and module 201 in the appropriate relative positions. Initial positioning may be facilitated by guides, magnetic connectors, or the like (not shown). The wrap 245 may comprise a connector, such as a magnetic strip 245 which may attach to the device 100 to secure the wrap to the device 100 and to retain the device 100 and the module 110 in place. The module 201 may be wirelessly connected to a power supply, controller, or power supply and controller of the device 100.

Figure 7:
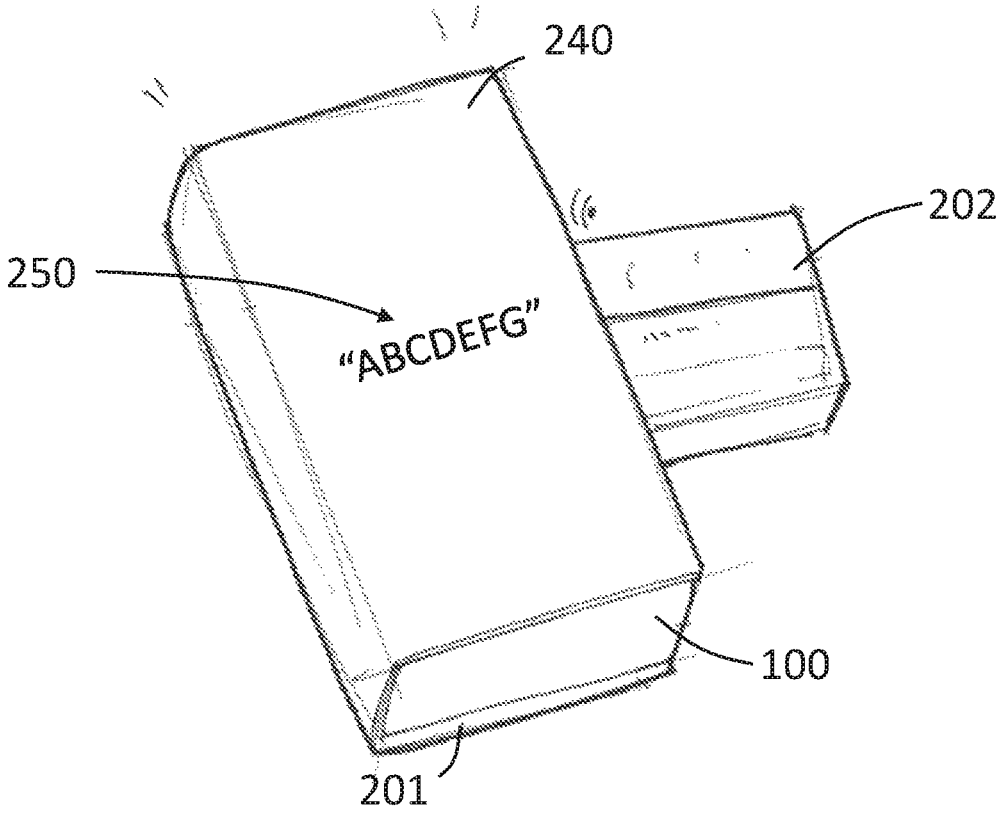
FIG. 7 is a schematic perspective view of an aerosol generating article and two modules.

FIG. 7 shows an embodiment where a wrap connector 240 that is part of module 210 includes a display 250. The wrap connector 240 may physically secure the aerosol generating device 100 relative to the module 210. Electrical connection between the module 201 and the device 100 may be wireless. A passive module 202, such as a container for consumables for use with the device 100, is also shown coupled to the device 100.

Figure 8:
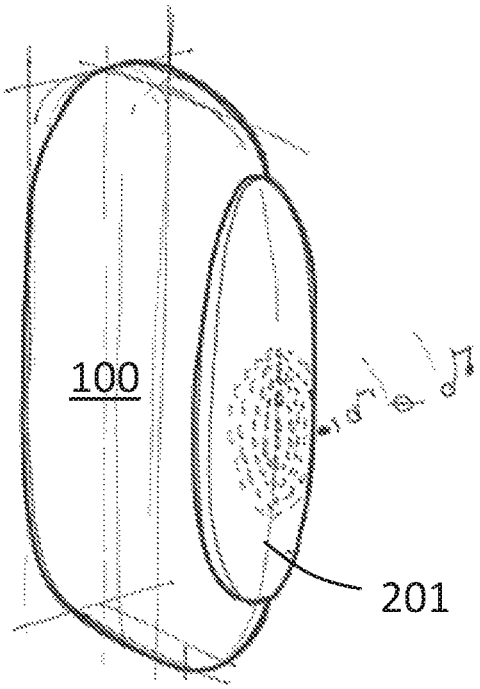
FIG. 8 is a schematic perspective view of an aerosol generating article and a module.

FIG. 8 shows a module 201 comprising a speaker operably coupled to the aerosol generating device 100.

Figure 9A:
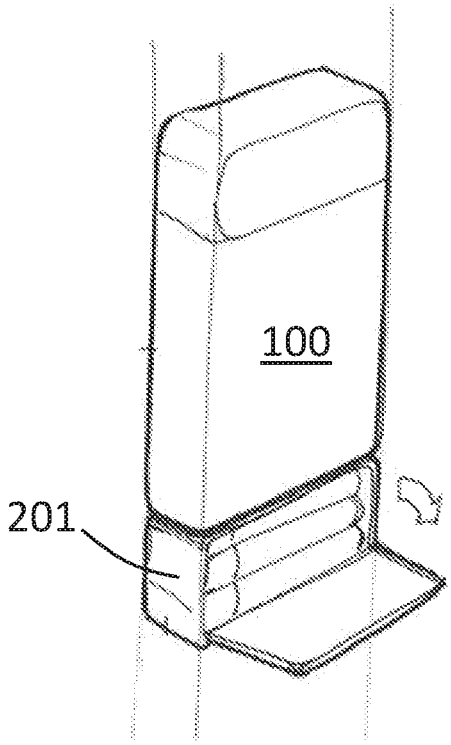
FIGS. 9A-9C are a schematic perspective views of an aerosol generating article and alternative modules connected to the device.
Figure 9B:
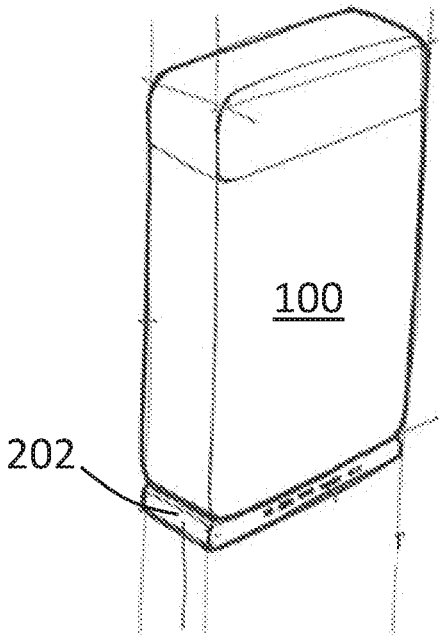
Figure 9C:
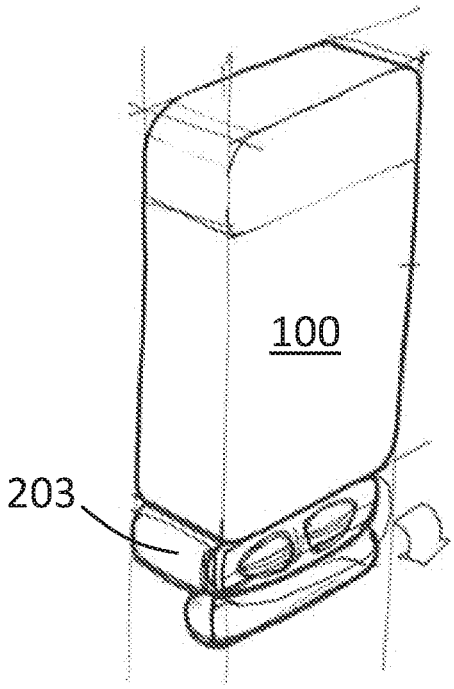

FIGS. 9A-9C show multiple modules 201, 202, 203 operably coupled to an aerosol generating device 100. The modules 201, 202, 203 may be swapped and individually connected as shown. Module 210 comprises a container for housing consumables, such as heat sticks, for use with the aerosol generating device 100. Module 202 includes a secondary battery and a battery level indicator. Module 203 includes a charging case for earpods.

Thus, aerosol generating devices with modular components are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol-generating device manufacturing or related fields are intended to be within the scope of the following claims.

The invention claimed is:

1. An aerosol generating system comprising:

an aerosol generating device comprising a housing;

a first module;

a second module;

a third module, wherein the first module is operably couplable to the aerosol generating device, to the second module, and to the third module, and wherein the second module is operably couplable to the first module, to the third module, and to the aerosol generating device, wherein the third module is operably couplable to the aerosol generating device, to the first module, and to the second module, and wherein each of the first module, the second module, and the third module are operably couplable to the aerosol generating device indirectly through another of the first module, second module, or third module when the other of the first module, the second module, or the third module is directly coupled to aerosol generating device through the housing.

2. An aerosol generating system according to claim 1, wherein operably coupling the second module to the first module, while the first module is operably coupled to the housing of the aerosol generating device, causes electronics of the second module to electrically couple to electronics of the aerosol generating device.

3. An aerosol generating system according to claim 2, wherein the first module is passive.

4. An aerosol generating system according to claim 1, wherein the housing of the aerosol generating device comprises a first connector to operably couple the first module and comprises a second connector to operably couple to the second module.

5. An aerosol generating system according to claim 4, wherein the second module is operably couplable to the first connector of the housing of the aerosol generating device, and wherein the first module is operably couplable to the second connection of the housing of the aerosol generating device.

6. An aerosol generating system according to claim 1, wherein the first module comprises a first electrical interconnect and a second electrical interconnect, and wherein operably connecting the first module with the housing of the aerosol generating device causes the first electrical interconnect to electrically couple with electronics of the aerosol generating device.

7. An aerosol generating system according to claim 6, wherein second module comprises a first electrical interconnect, and wherein operably connecting the second module with the first module causes the first electrical interconnect of the second module to electrically couple with the second electrical interconnect of the first module such that the first electrical interconnect of the second module is electrically coupled to the electronics of the aerosol generating device when the first module is operably coupled to the housing of the aerosol generating device.

8. An aerosol generating system according to claim 1, further comprising one or more additional modules, wherein each additional module is operably couplable to one or more of another additional module, the first module, the second module, and the housing of the aerosol generating device.

9. An aerosol generating system according to claim 1, wherein the first module and the second module are each independently selected from the group consisting of a module comprising an auxiliary battery, a module comprising wireless communication apparatus, a module comprising a wireless charger, a module comprising an interconnect for wired charging, a module comprising an electric lighter, a module comprising an electric security element, a module comprising a heater, a module comprising a charging case for wireless ear pods, a module comprising a fan, a module comprising a display, a module comprising a speaker, a module comprising a flashlight, a module comprising a wireless remote, a module comprising a projector, a module comprising a camera, a module comprising haptic feedback apparatus, a module comprising a sensor, a module comprising a NFC reader, a module comprising a processor and memory, a module comprising a USB hub, a module comprising GPS apparatus, a module comprising a container for one or more of a spent aerosol generating article, cash money, a payment cart, a business card, keys, a module comprising an analog watch, a module comprising a charging cable or a data stick, a module comprising a bottle opener, a module comprising a pen, a module comprising an ear bud holder, and a module comprising a keychain ring.

10. An aerosol generating system according to claim 1, wherein the aerosol generating device is configured to generate an aerosol from a substrate for inhalation by a user.

11. An aerosol generating system according to claim 10, wherein the system comprises the substrate and the substrate comprises tobacco.

12. An aerosol generating system according to claim 10, wherein the system comprises the substrate and the substrate comprises nicotine.

13. An aerosol generating system according to claim 1, wherein the aerosol generating device comprises a power source.

* * * * *